United States Patent [19]

Bataille

[11] 4,178,013

[45] Dec. 11, 1979

[54] FIXING DEVICE FOR SECURING NON-RIGID SHOES ON SKIS

[76] Inventor: Jean R. Bataille, 20, rue du Commandant René Mouchette, Paris, France

[21] Appl. No.: 771,250

[22] Filed: Feb. 23, 1977

[30] Foreign Application Priority Data

Feb. 25, 1976 [FR] France ..... 76 05252
Feb. 14, 1977 [FR] France ..... 77 04133

[51] Int. Cl.[2] ..... A63C 9/086

[52] U.S. Cl. ..... 280/618; 36/119; 280/611; 280/615

[58] Field of Search ..... 280/611, 612, 613, 615, 280/617, 618, 634, 616; 36/119, 120

[56] References Cited

U.S. PATENT DOCUMENTS

| | | | |
|---|---|---|---|
| 3,528,672 | 9/1970 | Wonder | 280/612 |
| 3,538,627 | 11/1970 | Labpt-Camy | 280/611 |
| 3,630,537 | 12/1971 | Brunner | 280/616 |
| 3,826,509 | 7/1974 | Smolka | 280/612 |
| 3,892,980 | 7/1975 | Anderson | 280/612 |
| 3,947,051 | 3/1976 | Sittmann | 280/611 |
| 4,060,256 | 11/1977 | Collombin et al. | 280/613 |

FOREIGN PATENT DOCUMENTS

| | | | |
|---|---|---|---|
| 2023534 | 12/1971 | Fed. Rep. of Germany | 280/612 |

*Primary Examiner*—David M. Mitchell
*Attorney, Agent, or Firm*—Wolf, Greenfield & Sacks

[57] ABSTRACT

A device for securing a skier's foot to a ski omits the necessity for the typical rigid ski boot and enables the skier to wear non-rigid shoes or boots. The invention relates to a device which is detachably connectible to the bindings of a ski and which includes a foot-receptive framework having interior expandable pads which may be inflated to press firmly against the skier's foot. The pads are inflated by a pump within the device which is operated by the user's foot in response to skiing motion and forces. The extent to which the pads are inflated is controlled by a pressure relief device interposed between the pump and the chocks.

7 Claims, 15 Drawing Figures

22
6
21
21
22
5
22
22
92
92
8
21
7
92
21
92
21
4
22
1
18
13
15
14
2
24
22
3

FIXING DEVICE FOR SECURING NON-RIGID SHOES ON SKIS

BACKGROUND AND SUMMARY OF THE INVENTION

This invention relates to improvements in skiing equipment, and, particularly, to an improved type of boot-binding configuration which enables a skier to attach the ski to his foot without requiring the use of special, typically rigid and heavy ski boots used in downhill skiing. The present invention relates to an arrangement by which the requirement for the heavy rigid ski boots is omitted and also provides a device which may be used with equal facility in downhill skiing as well as in cross-country skiing. In this regard, cross-country skiing typically requires a very different type of boot than downhill skiing, in that the cross-country boot must be very flexible and non-rigid. Thus, it is among the general objects of the present invention to provide an arrangement which may be used either for downhill or for cross-country skiing.

In brief, the device includes a foot-receptive framework which is detachably connected to the ski bindings. The framework carries inflatable (and deflatable) pads or chocks on its interior which expand against the user's foot to secure it in place. The chocks are maintained in a foot-engaging inflated condition by a bellows which is located within the framework and which is actuated in response to movement and forces of the skier's foot to feed fluid under pressure to the chocks and maintain the rigid condition. The device includes pressure relief valving arrangements interposed between the bellows or pump and the chocks to regulate the pressure of the pressure of the chocks.

It also is among the general objects of the invention to provide an improved device for securing a ski to a skier's foot.

A further object of the invention is to provide a device of the type described which does not require the use of the typical heavy and rigid ski boots which have heretofore been employed.

Another object of the invention is to provide a device of the type described in which the clamping force of the device on the skier's foot may be varied so as to be suitable for downhill skiing or for cross-country skiing.

DESCRIPTION OF THE DRAWINGS

The foregoing and other objects and advantages of the invention will be understood with the following further description thereof, with reference to the accompanying drawings in which.

DESCRIPTION OF THE PREFERRED EMBODIMENT

Figure 1:
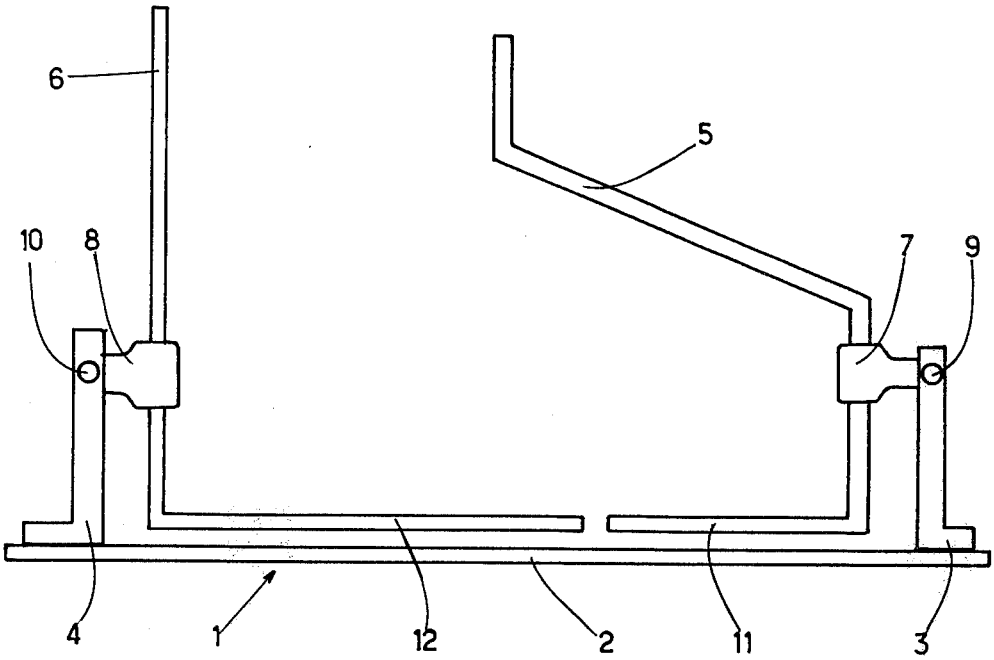
FIG. 1 is a highly diagrammatic side elevation of the base member and the framework of the device, omitting the chocks and bellows.

As illustrated in FIG. 1 the device, indicated generally by the reference character 1 includes a base member 2 having a toe end and a heel end. The base member 2 is intended to be secured to any of a variety of commercially available ski bindings to detachably secure the device to a ski. Mounted to the base 2 is a framework which, as illustrated in FIG. 1 may include a front frame section 5 and a rear frame section 6. In this embodiment of the invention, the front frame section 5 is pivoted at its toe end to the base member 2 as by a bracket 3 which is secured to the base member, a pivot 9 and a framework clamp 7. Framework clamp 7 also grips the front frame member 5 in a manner which enables the height of the front framework member 5 to be adjusted. The assembly of front framework member 5 and clamp 7 thus may hinge about the pivot 9. Similarly, the rear frame 6 is pivotally mounted to the more rearward portion of the base member 2 as by a bracket 4, clamp 8 and pivot 10. As illustrated, each of the front and rear frame members 5, 6 includes a sole plate 11, 12 respectively.

Figure 4:
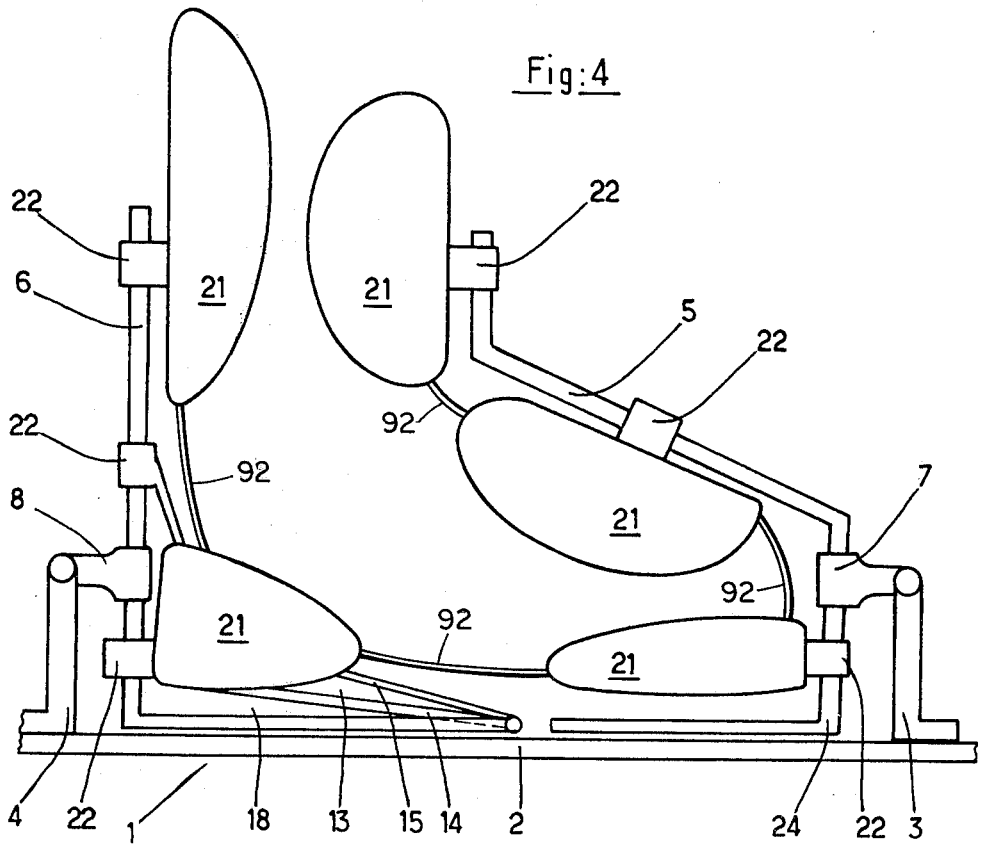
FIG. 4 is a side elevation similar to FIG. 1 which illustrates, diagrammatically, the chocks and incorporates the bellows.
Figure 9:
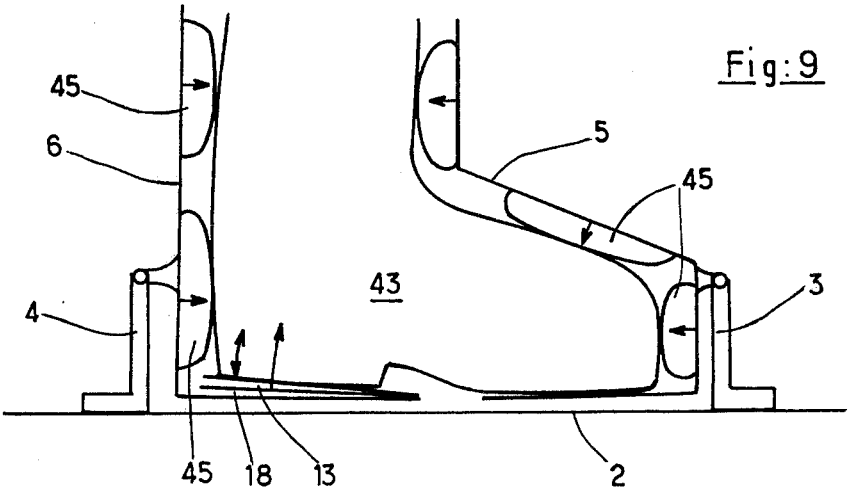
Figure 10:
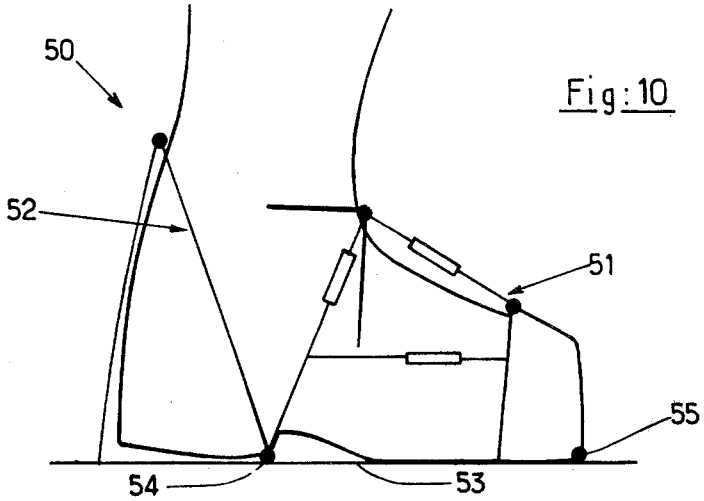
FIGS. 10 and 11 are diagrammatic side elevations of an embodiment of the invention in which only the front shell of the framework is hinged to the base member, the rear shell of the framework being hinged to the rear end of the front shell.
Figure 11:
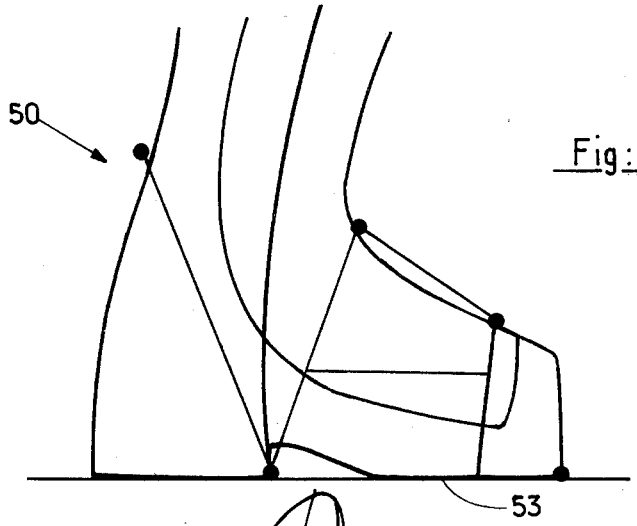
Figure 12:
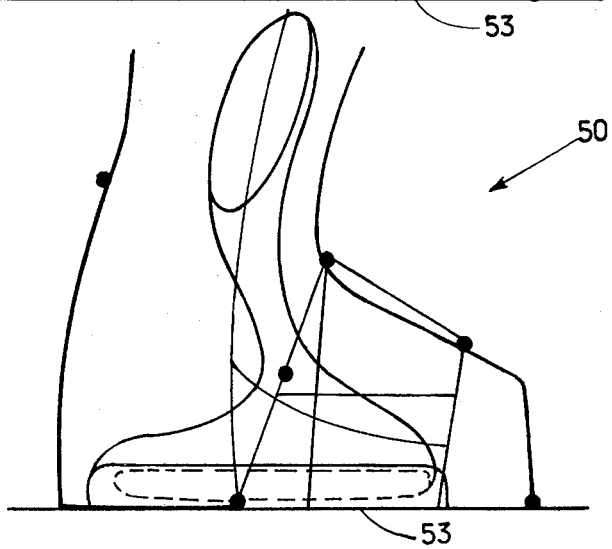
FIG. 12 is a part side illustration device shown in FIG. 10.

FIG. 4 illustrates, diagrammatically, a plurality of shell members 21 as they may be secured to the framework in order to provide surfaces adapted to encircle and surround a skier's foot. The shell elements 21 may be secured to the framework by connectors 22 which, preferably, are constructed and arranged so that their position may be adjusted on the framework to suit the needs of a particular skier. As will be described, inflatable chocks are carried by the inner surfaces of the shells 21 and are inflated or expanded to effect a firm grip on the skier's foot. For example, FIG. 9 illustrates a number of such inflatable chocks indicated at 45.

The chocks 45 are inflated by a pump or bellows 13 (FIG. 2) which may be mounted to the sole plate 12 associated with the rear frame member 6. The bellows 13 may be formed by a pair of plates 14, 15 which are hinged to the sole plate 12 at a pivot 16. A flexible sidewall 17 completes the periphery of the bellows 13. The bellows 13 may itself rest on a pneumatic heel chock 18 which may be in direct communication with the bellows 13 and be inflated in a manner similar to the inflation of the other chocks 45.

Figure 5:
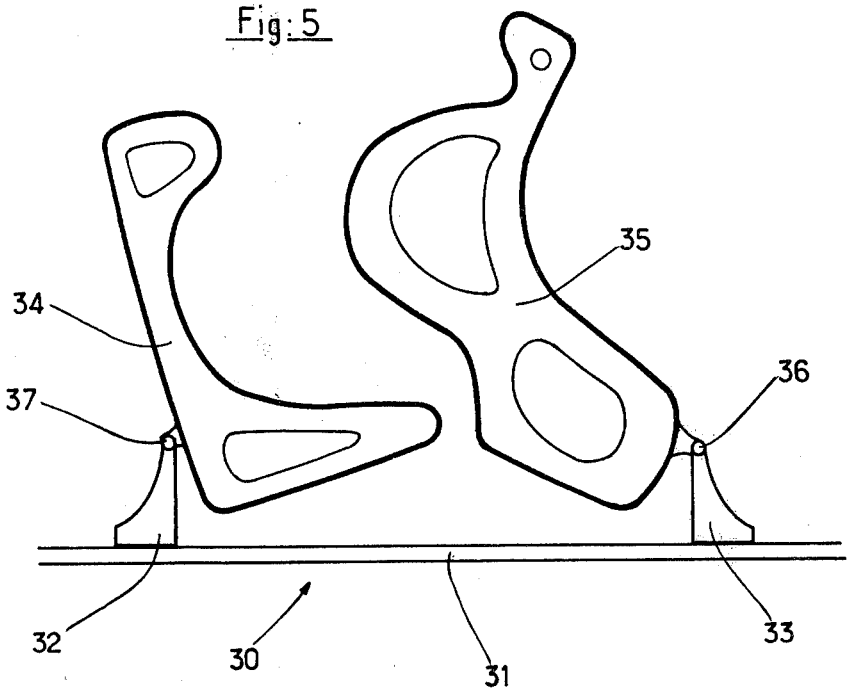
FIG. 5 is a further, less diagrammatic illustration of framework consisting of a pair of shells which are pivoted to the base between foot receptive and foot-locking configurations.

FIG. 5 illustrates a device in which the framework and shells are formed in a single, integral piece, rather than the independent framework and movable shells illustrated in FIG. 4, as described above. As shown in FIG. 5, the base 31 is provided with brackets 32 and 33 to which integral framework-shells 34, 35 are hinged at pivots 36, 37.

Figure 6:
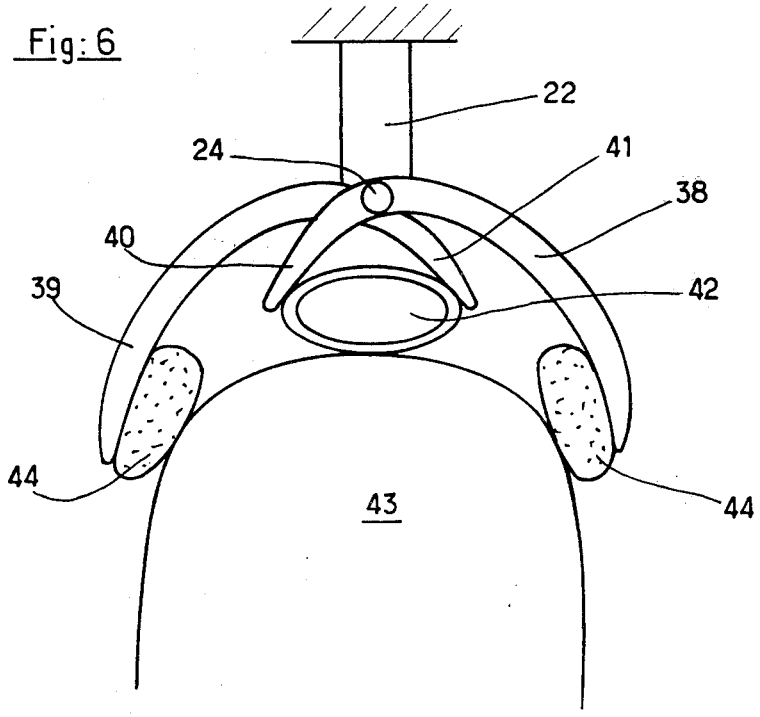
FIG. 6 is a diagrammatic plan view of an arrangement of chocks adapted to engage the toe end of the skier's shoe.

FIG. 6 illustrates, somewhat diagrammatically, a chock configuration which may be employed at the toe end of the device. As shown, a pair of shells 38, 39 are pivotally connected to a bracket 22 for pivotal movement toward and away from the sides of the toe portion of an inserted foot, about the axis 24. These shells may be pivoted at the axis at a location intermediate the ends of the shells so that each shell defines what may be considered as a pair of outer pincers 38, 39 and a pair of more inwardly and toewardly disposed pincers 40, 41. A pneumatic chock 42 is disposed in between the inwardly disposed pincers 40, 41 at the intended location of the toe end of the inserted shoe. When the chock 42 is inflated by the bellows, it will press against the toe end of the shoe and also will urge the more outwardly disposed pair of toe pincers inwardly into clamping engagement with the shoe. Pads 44 may be secured to the outer ends of the more outwardly disposed pincer-portions of the shells 38, 39. It should be noted that although the configuration illustrated in FIG. 6 is described only with regard to engagement of the toe end of the shoe, this configuration could be employed in association with other shells at other locations on the device.

Figure 7:
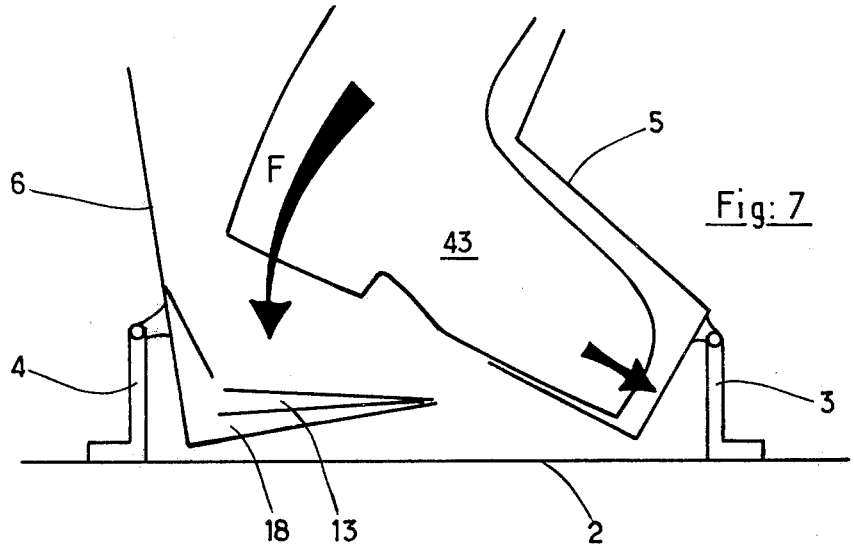
FIGS. 7, 8 and 9 are diagrammatic side elevations illustrating the manner in which the skier's foot is inserted into the device and the manner in which the device is actuated to inflate the chocks and secure the device to the skier's foot.
Figure 8:
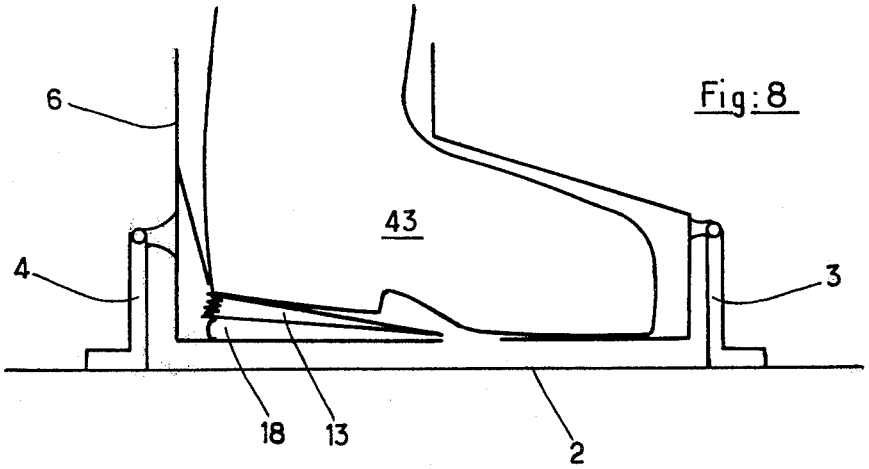

FIGS. 7, 8, and 9 illustrate, diagrammatically, the manner in which a user may employ the device to secure a ski to his foot. As shown in FIG. 7, the skier first puts his foot 43 into the front framework 5 and then brings his heel downwardly, in the direction illustrated by the arrow F, so that the shoe will rest on the bellows 13. The heel then is urged firmly and downwardly which causes the frameworks 5, 6 to pivot to their closed configuration (FIG. 8). Further pumping of the bellows 13, by the user's heel, will cause the heel chock 18 as well as the other chocks 43 and/or 45 to inflate with a fluid medium. As described, the bellows 13 is in communication with the chocks by suitable conduits 90, 92. The bellows 13 and chocks 43, 45 may be pneumatic and may utilize ambient air. Alternatively, the device may be operated by a liquid, in which case a separate supply reservoir (indicated diagrammatically at R in FIG. 2) may be mounted to the device at a convenient location and in communication with the bellows 13 (as, for example, by a conduit indicated diagrammatically at 94).

Figure 2:
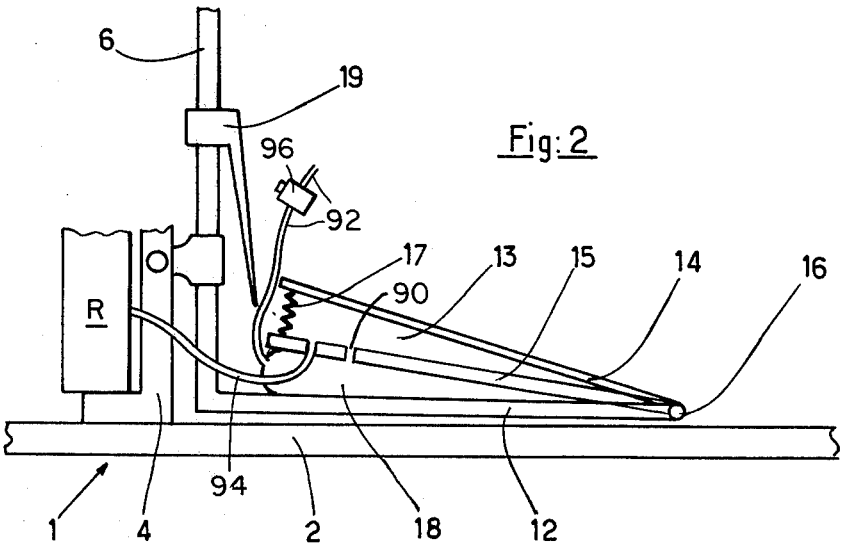
FIG. 2 is a highly diagrammatic side elevation of the heel region of the framework showing the pump bellows.

The chocks may be connected to the bellows either in series or in parallel, as desired. In order to control the pressure which the bellows may apply to the chocks, a pressure relief valve indicated diagrammatically at 96 of a known type, is interposed in the fluid conduit between the bellows and chocks, for example, in the line 92 as shown in FIG. 2. For example, the pressure relief valve may be mounted to the base or in any other convenient location. Alternatively, relief valves may be associated with each individual chock to enable the pressure in each to be regulated independently of the other.

Figure 13:
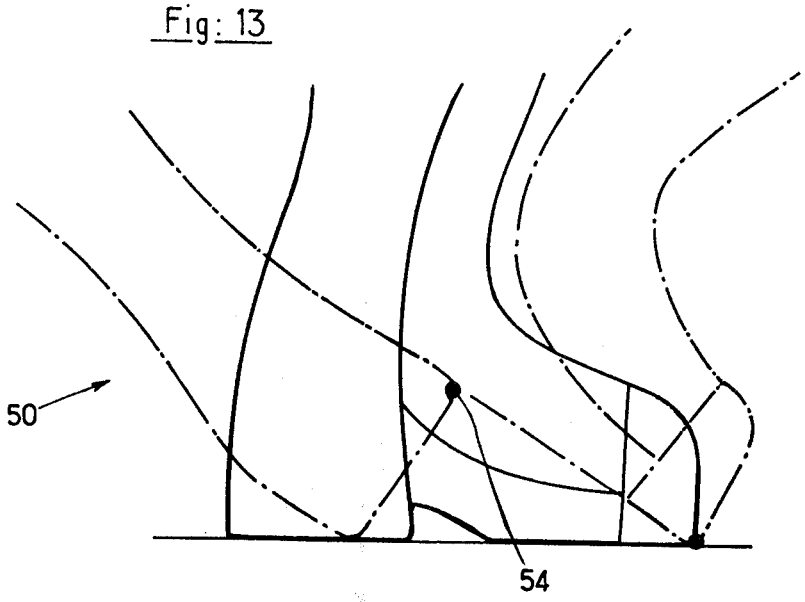
FIG. 13 is a side elevation illustrating the device of FIGS. 10–12 in its closed configuration in solid and in its open configuration in phantom.
Figure 14:
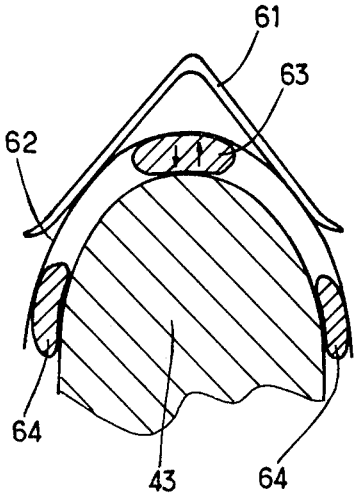
FIG. 14 is a diagrammatic plan view of portion of the chocks at the front region of the device shown on FIG. 10.
Figure 3:
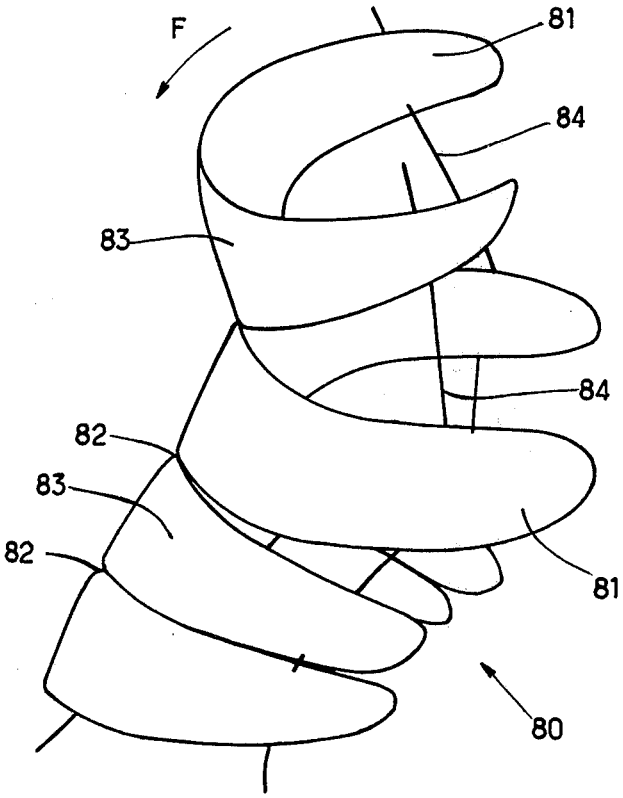
FIG. 3 is an illustration of a modified type of shell construction in which the shell is formed from a plurality of articulated members.

FIGS. 10–13 illustrate an alternate embodiment of the invention, indicated generally at 50, which includes a front framework 51 and a rear framework 52. The frameworks 51, 52 are hinged to each other as indicated at the pivot 54 and only the front framework is hinged to the base 53, at the pivot 55. The manner in which this embodiment of the invention is opened and closed is illustrated in FIG. 13, in which the closed configuration is shown in solid and the open, foot-receptive configuration is illustrated in phantom.

FIG. 15 illustrates still another type of shell configuration, indicated generally by the reference character 80. In this configuration, the shell consists of a number of shell segments 81 which are articulated to each other at hinge points 82. The shell segments 81 define an assembly which is intended to be highly flexible and shaped to correspond to the configuration of the user's foot. The free ends of the shell segments may be interconnected by flexible rods which can be adjusted lengthwise with respect to the free ends of the shell segments 81 to control the degree to which the shell segments may hinge with respect to each other. In addition, release of the rods 84 will enable the hinged sections 81 to hinge freely which facilitates walking with the device.

It should be understood that the foregoing description of the invention is diagrammatic only, and that there may be some embodiments and modifications of the invention apparent to those skilled in the art without departing from its spirit.

Having thus described the invention, what I desire to claim and secure by Letters Patent is:

1. A device for securing a skier's foot to a ski, said ski having a binding mounted thereto, the device comprising:

a base member detachably connectible to the ski binding;

framework means mounted to the base member, the framework means being adapted to receive a skier's foot within the framework;

expandable chock means mounted to the interior of the framework to engage and clamp the skier's foot;

pump means carried by the framework and in communication with the chock means to supply the chock means with a fluid medium to expand the chock means;

said pump means being located within the framework to be operative by motions and forces of the skier's foot on the pump means; and valve means interposed between the pump means and the chock means to control the pressure applied to the chock means by the pump means.

2. A device as defined in claim 1 wherein the fluid medium is gaseous.

3. A device as defined in claim 1 wherein the pump means is located within the framework at the heel region thereof so as to be disposed below the skier's heel and to be responsive to vertical movements and forces of the skier's heel.

4. A device as defined in claim 1 wherein the framework means comprises a pair of shells secured to the base and including a front shell and a rear shell, the front shell being pivoted at its toe region to the base and the rear shell being pivoted at its heel region to the base, the shells being pivotable between a closed, foot-encompassing configuration and an open, foot-receptive configuration;

said chock means including at least one chock mounted to the interior of each of the shells.

5. A device defined in claim 1 wherein the fluid medium comprises a liquid.

6. A device defined in claim 1 further comprising a source of fluid medium carried by the framework and in communication with the pump means to enable fluid medium to flow between the source thereof and the chock means.

7. A device as defined in claim 6 wherein the source of supply comprises an supply reservoir.

* * * * *